US008777279B2

(12) United States Patent
Kothy

(10) Patent No.: US 8,777,279 B2
(45) Date of Patent: Jul. 15, 2014

(54) CONTAINER COVER/DOOR WITH HIGH SECURITY LOCKING SYSTEM

(75) Inventor: Srinivas Kothy, North Ridgeville, OH (US)

(73) Assignee: Multilink, Inc., Elyria, OH (US)

( * ) Notice: Subject to any disclaimer, the term of this patent is extended or adjusted under 35 U.S.C. 154(b) by 318 days.

(21) Appl. No.: 13/301,835

(22) Filed: Nov. 22, 2011

(65) Prior Publication Data

US 2013/0126532 A1 May 23, 2013

(51) Int. Cl.

| | |
|---|---|
| ***E05C 1/02*** | (2006.01) |
| ***E05C 1/12*** | (2006.01) |
| ***E05B 35/00*** | (2006.01) |
| ***E05B 17/20*** | (2006.01) |
| *E05C 1/08* | (2006.01) |

(52) U.S. Cl.

CPC ..... *E05B 17/2084* (2013.01); *E05C 1/12* (2013.01); *E05B 35/008* (2013.01); *Y10S 292/11* (2013.01)

USPC ..... 292/137; 292/140; 292/149; 292/163; 292/DIG. 11

(58) Field of Classification Search

USPC ..... 292/1.5, 137, 138, 140, 142, 149, 155, 292/160, 163, 169, 172, 175, 176, 251, 357, 292/359, DIG. 11, DIG. 68

See application file for complete search history.

(56) References Cited

U.S. PATENT DOCUMENTS

| | | | | | |
|---|---|---|---|---|---|
| 234,866 | A | * | 11/1880 | Forg | 292/74 |
| 888,911 | A | * | 5/1908 | Lamberson | 292/169.21 |
| 999,891 | A | * | 8/1911 | Sheppard | 292/251 |
| 1,197,313 | A | * | 9/1916 | Weiland | 292/140 |
| 1,521,572 | A | * | 12/1924 | Hammer et al. | 292/175 |
| 1,571,453 | A | * | 2/1926 | Maxon | 292/170 |
| 1,807,527 | A | * | 5/1931 | Hanny | 292/256.75 |
| 2,223,765 | A | * | 12/1940 | Komenak | 292/337 |
| 3,737,184 | A | * | 6/1973 | Swartz | 292/170 |
| 3,770,306 | A | * | 11/1973 | Nystrom | 292/169 |
| 3,782,139 | A | * | 1/1974 | Rubner | 70/81 |
| 3,830,535 | A | * | 8/1974 | Read et al. | 292/170 |
| 4,058,333 | A | * | 11/1977 | Roe et al. | 292/172 |
| 5,345,795 | A | | 9/1994 | James et al. | |
| 5,412,960 | A | | 5/1995 | James et al. | |
| 5,730,567 | A | | 3/1998 | Haseley et al. | |
| 5,860,302 | A | | 1/1999 | James | |
| 6,343,816 | B1 | * | 2/2002 | King | 292/165 |
| 7,891,904 | B2 | * | 2/2011 | Stadler | 404/25 |
| 2010/0236298 | A1 | | 9/2010 | James et al. | |

FOREIGN PATENT DOCUMENTS

| | | | |
|---|---|---|---|
| DE | 3937046 | * | 5/1991 |

* cited by examiner

*Primary Examiner* — Carlos Lugo

(74) *Attorney, Agent, or Firm* — Renner, Otto, Boisselle & Sklar, LLP

(57) ABSTRACT

Container cover/door with high security locking system comprises a metal cover/door having a first through opening surrounded by a first metal sleeve or collar extending inwardly from the outer surface of the cover/door. Fixedly attached to the inner surface of the cover/door is a metal bracket having a second through opening surrounded by a second metal sleeve or collar that extends outwardly within the first collar. The locking system comprises a locking mechanism including a spring loaded latch contained within a housing mounted to an inner surface of the metal bracket, and a security pin having a pin head that is encased within the second collar with a close tolerance therebetween, and a pin shaft of a smaller diameter than the pin head that extends inwardly from the pin head through an opening in the locking mechanism.

18 Claims, 4 Drawing Sheets

CONTAINER COVER/DOOR WITH HIGH SECURITY LOCKING SYSTEM

FIELD OF THE INVENTION

This invention relates to a container cover/door with high security locking system that is based on rotation of a security pin to force a lock to unlock.

BRIEF SUMMARY OF THE INVENTION

The present invention relates to a container cover/door with high security locking system that includes a security pin that allows most standard industry drivers that include a designated pattern that matches the pattern on the front face of the pin head to rotate the security pin to force the locking mechanism of the locking system to unlock while virtually preventing unauthorized/forceful rotation of the security pin using other means. Also the locking system prevents any direct abuse to the pin head from transferring to the locking mechanism.

In accordance with one aspect of the invention, the head of the security pin is encased in a metal sleeve or collar that prevents unauthorized forceful rotation of the security pin.

In accordance with another aspect of the invention, the security pin is never in contact with the spring that urges the latch of the locking mechanism to the fully extended/locked position.

In accordance with another aspect of the invention, a portion of the shaft of the security pin has a non-cylindrical profile that matches the profile of an opening in the metal body of the locking mechanism that receives the non-cylindrical profile to provide smooth lock operation.

In accordance with another aspect of the invention, a metal barrier between the head of the security pin and the locking mechanism prevents damage to be inflicted to the locking mechanism from the outside.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION

A container cover/door with locking system of the present application comprises a metal cover/door having a first through opening surrounded by a first metal sleeve or collar extending inwardly from the outer surface of the cover/door. Fixedly attached to the inner surface of the cover/door is a metal bracket having a second through opening surrounded by a second metal sleeve or collar that extends outwardly within the first collar. The locking system comprises a locking mechanism including a spring loaded latch contained within a housing mounted to an inner surface of the metal bracket. A security pin having a pin head of a larger outer diameter than the pin shaft is encased within the second collar with a close tolerance therebetween, and the pin shaft extends inwardly from the pin head through an opening in a metal body of the locking mechanism. A metal barrier between the locking mechanism and the metal bracket has a hole through which the pin shaft extends that is of a smaller diameter than the outer diameter of the pin head, whereby the surface of the metal barrier surrounding the hole acts as a stop for the pin head and prevents damage to be inflicted to the locking mechanism from the outside.

Figure 1:
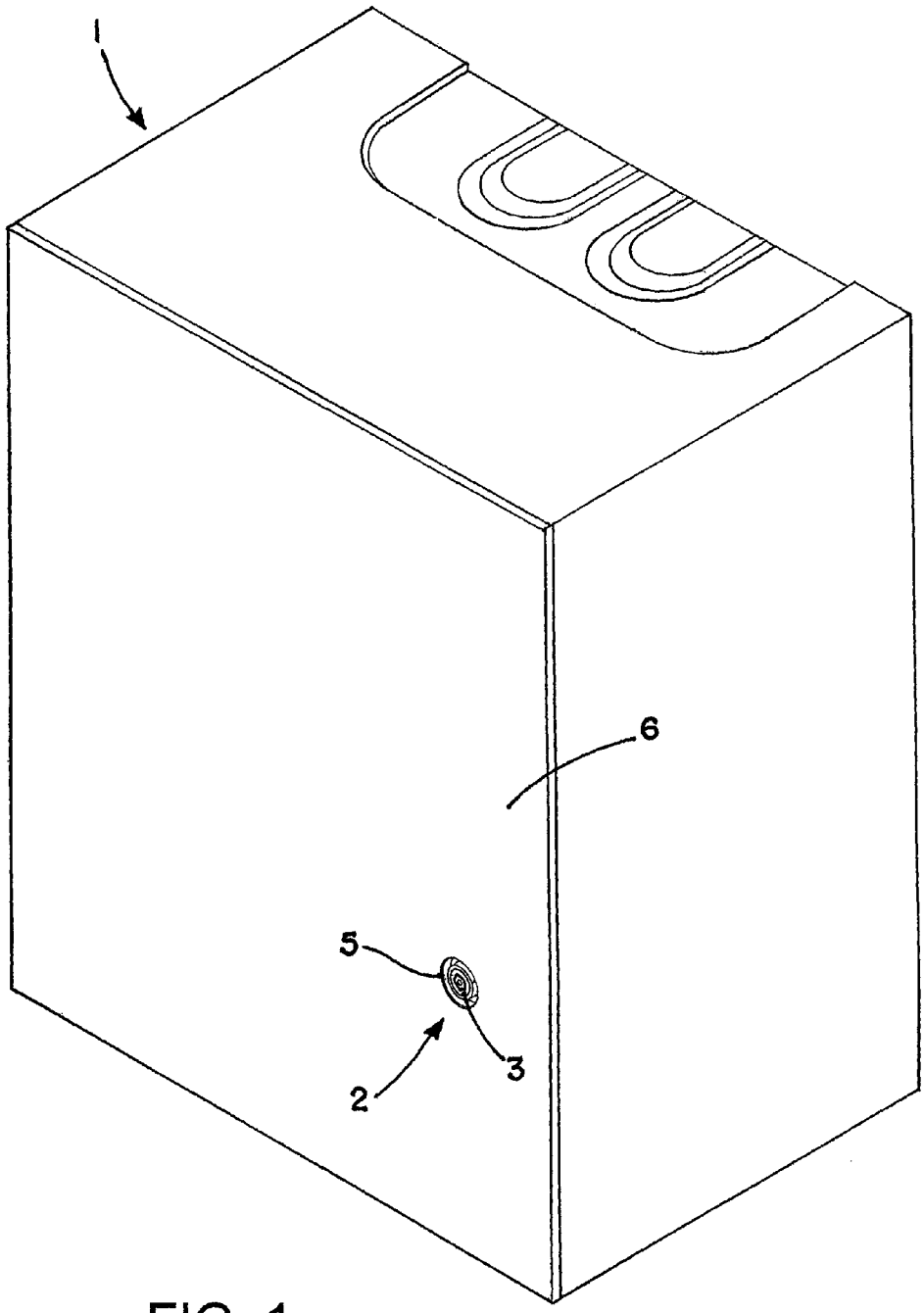
FIG. 1 is a schematic perspective view of the outside of an exemplary container cover/door with locking system embodiment of the present invention.
Figure 2:
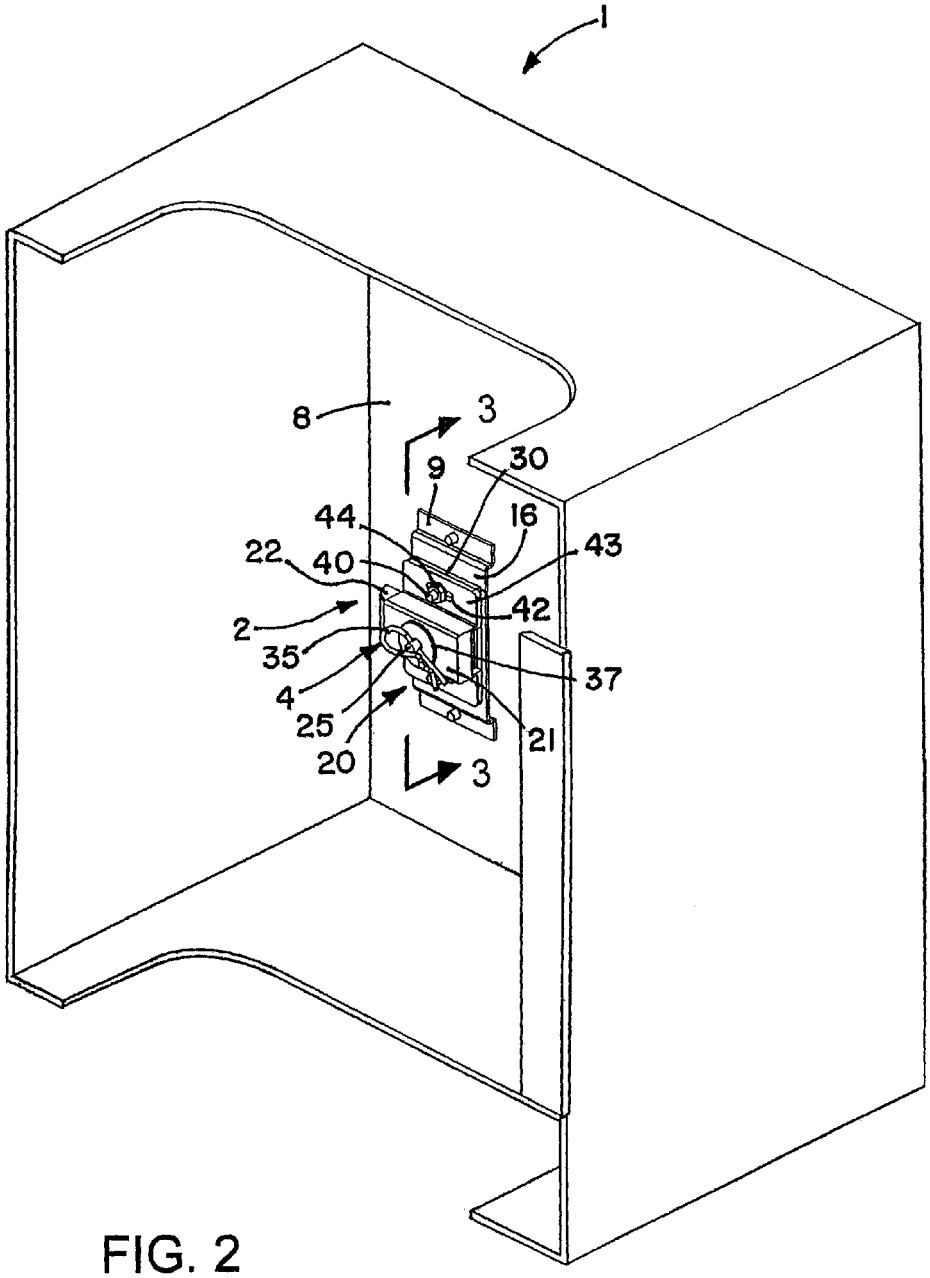
FIG. 2 is a schematic perspective view of the inside of the container cover/door of FIG. 1 showing the locking mechanism of the locking system mounted therewithin.
Figure 3:
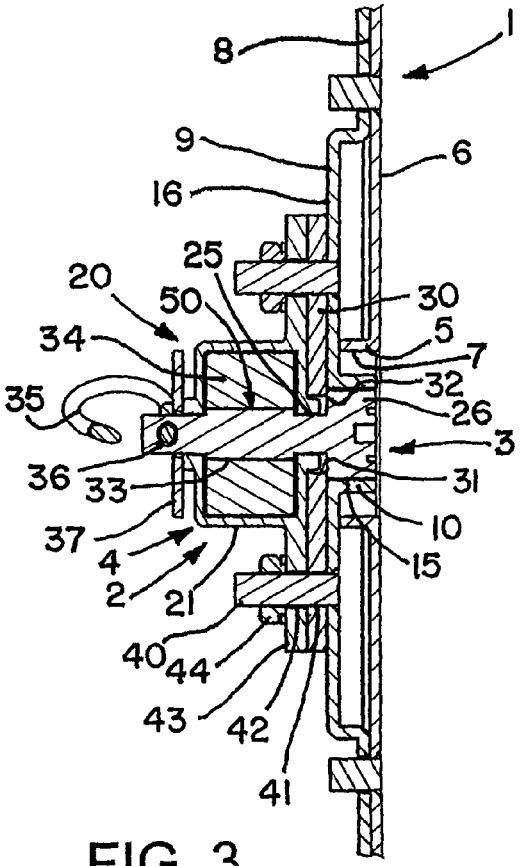
FIG. 3 is an enlarged partial section through the cover/door and locking system of FIG. 2 taken on the plane of the line 3-3 thereof.

Referring now in detail to the drawings, and initially to FIGS. 1-3, there is schematically shown an example of a cover/door 1 with high security locking system 2 of the present invention for locking the cover/door to a container (not shown). The locking system 2 is based on rotation of a security pin 3 using a compatible industry driver (not shown) to force a locking mechanism 4 mounted on an inside surface of the cover/door to unlock while virtually preventing unauthorized/forceful rotation of the security pin using other means as described hereafter. Also the cover/door with locking system prevents damage to be inflicted to the locking mechanism from the outside as described hereafter.

Figure 7:
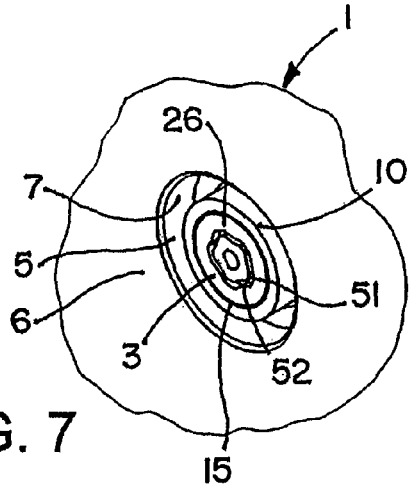
FIG. 7 is an enlarged fragmentary perspective view of an opening in the outer surface of the cover/door of FIG. 1 containing a metal sleeve or collar in which the head of the security pin is encased with a close tolerance therebetween to prevent unauthorized forceful rotation of the security pin from the outside.

Preferably the cover/door 1 is made of sheet metal, and as best seen in FIGS. 3 and 7, includes an extruded first metal sleeve or collar 5 extending inwardly from the outer surface 6 of the cover/door 1 that defines an opening 7 therethrough. Welded or otherwise permanently affixed to an inner surface 8 of the cover/door 1 is a sheet metal bracket 9 having an extruded second metal sleeve or collar 10 extending outwardly therefrom concentrically within the first metal collar 5 and defining an opening 15 through the metal bracket. Welding the metal bracket 9 to the inner surface 8 of the cover/door 1 virtually makes both metal collars 5 and 10 one solid piece.

Figure 8:
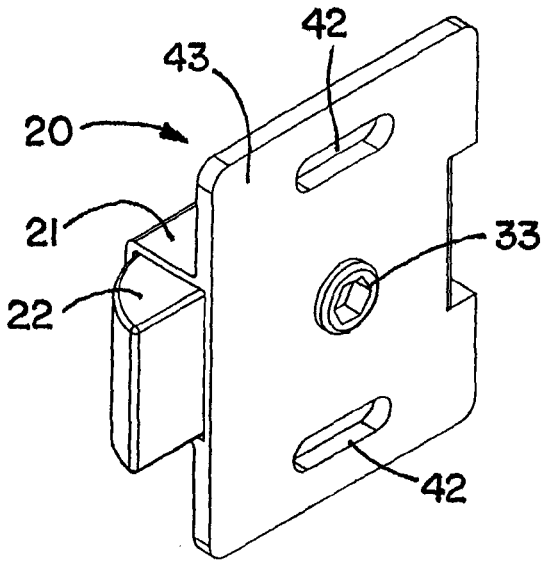
FIGS. 8 and 9 are enlarged perspective views of opposite sides of the locking mechanism of the locking system.
Figure 9:
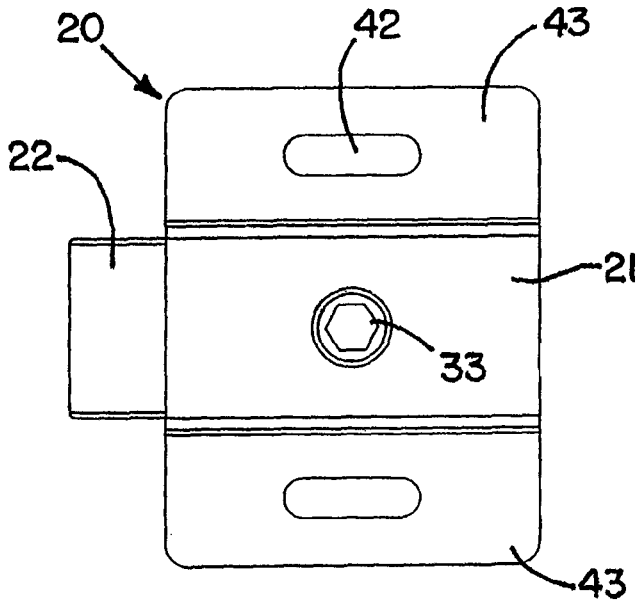

Mounted to the inner surface 16 of the metal bracket 9 in line with the opening 15 is a locking mechanism 20 including a housing 21 containing a spring loaded latch 22 (see FIGS. 2, 8 and 9). The functionality of the locking mechanism 20 is based on rotation of the security pin 3 to force the spring loaded latch 22 to unlock as described hereafter.

As seen in FIGS. 3-6, the security pin 3 comprises a pin shaft 25 and a pin head 26 having a larger outer diameter than the pin shaft. The metal bracket collar 10 is sized for flush or recess mounting of the pin head 26 within the metal bracket collar 10 with a close tolerance therebetween. By way of example, the clearance between the outer diameter of the pin head 26 and the inner diameter of the metal bracket collar 10 is less than 0.125 inch.

Between the locking mechanism 20 and the metal bracket 9 is a metal barrier 30. Extending through the metal barrier 30 is a hole 31 that is in alignment with the opening 15 in the metal bracket 9. The hole 31 in the metal barrier 30 is sized for extension of the pin shaft 25 through the hole, but not the pin head 26. Accordingly, the surface 32 of the metal barrier 30 surrounding the hole 31 acts as a stop for the pin head 26. When the pin head 26 is fully seated within the metal bracket collar 10, the pin shaft 25 extends through an opening 33 in the metal body 34 of the locking mechanism 20 and out beyond the locking mechanism housing 21.

Unauthorized removal of the security pin 3 from the cover/door 1 is prevented, for example, by inserting a cotter pin 35 through a hole 36 in the inner end of the pin shaft 25 inwardly of the locking mechanism 20 (see FIGS. 2 and 3). Other suitable means may also be used for preventing unauthorized removal of the security pin 3 from the cover/door 1, including, for example, attaching a lock ring (not shown) to the inner end of the pin shaft. A washer 37 is shown interposed between the pin 35 and the housing 21 of the locking mechanism 20 to take up any excess clearance space therebetween.

The metal barrier 30 and locking mechanism 20 may be secured to the metal bracket 9 in any suitable manner, for example, by studs 40 extending inwardly from the metal bracket 9 through aligned slots 41, 42 in the metal barrier 30 and flanges 43 of the locking mechanism housing 21 and threading nuts 44 onto the inner ends of the studs as schematically shown in FIGS. 2 and 3.

Figure 6:
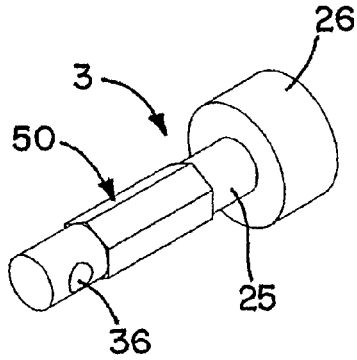
FIG. 6 is a perspective view of the security pin of FIG. 4.
Figure 4:
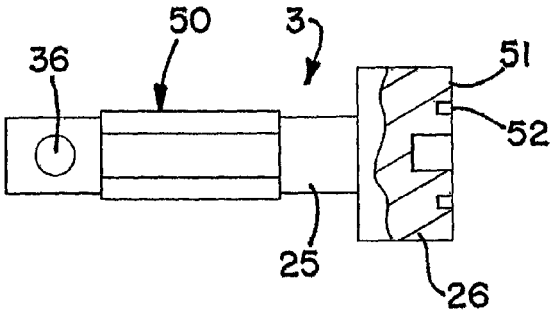
FIG. 4 is an enlarged side view of the security pin of the locking system with portions of the pin head broken away to show a groove pattern on the front face thereof.
Figure 5:
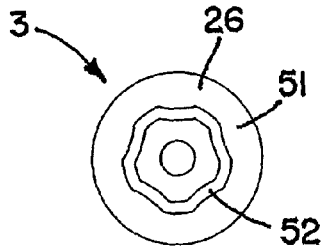
FIG. 5 is an end view of the front face of the head portion of the security pin of FIG. 4.

As seen in FIGS. 4 and 6, the pin shaft 25 has a non-cylindrical portion 50 intermediate the ends thereof that is received in the opening 33 in the metal body 34 of the locking mechanism. Also, as seen in FIGS. 8 and 9, the opening 33 in the metal body 34 of the locking mechanism 20 that receives the non-cylindrical portion of the pin shaft 25 has a non-cylindrical shape that matches the non-cylindrical portion 50 of the pin shaft, whereby when the security pin 3 is rotated a part turn, the metal body 34 causes the spring loaded latch 22 to retract against the force of a spring (not shown). When the rotating force on the security pin 3 is released, the spring will cause the latch 22 to return to its fully extended/locked position. In the embodiment disclosed herein, the non-cylindrical portion 50 of the pin shaft 25 and matching non-cylindrical opening 33 through the metal body 34 of the locking mechanism 20 have matching hex profile patterns to provide smooth locking operation without the security pin ever directly contacting the spring.

To enable rotation of the security pin 3 a part turn, the outer face 51 of the pin head 26 has a curvilinear groove pattern 52 (see FIGS. 4-7) that is engageable by a designated pattern driver (not shown) having a matching pattern. The pattern 52 on the outer face 51 of the pin head 26 may vary depending on the customized pattern desired.

When the cover/door 1 with locking system 2 is fully assembled, the outer face 51 of the pin head 26 is flush with the outer end of the metal bracket collar 10 and both the outer end of the metal bracket collar 10 and outer face 51 of the pin head 26 are either flush or recessed with respect to the outer surface 6 of the cover/door 1 (see FIGS. 3 and 7). This, coupled with the close tolerance between the outer diameter of the pin head 26 and the inner diameter of the metal bracket collar 10, prevent any unauthorized/forceful rotation of the security pin 3 by means other than a designated pattern driver, for example, a pair of pliers. Also the metal barrier 30 between the pin head 26 and the locking mechanism 20 prevents any direct contact between the underside of the pin head and the locking mechanism at any time, thereby preventing any direct abuse to the pin head from transferring to the locking mechanism.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A container cover/door with high security locking system, the cover/door being made of metal and having a first through opening surrounded by a first metal collar extending inwardly from an outer surface of the cover/door, a metal bracket fixedly attached to an inner surface of the cover/door, the metal bracket having a second through opening surrounded by a second metal collar extending outwardly within the first collar, and the locking system comprising a locking mechanism including a housing containing a spring loaded latch, the housing being mounted to an inner surface of the metal bracket, and a security pin comprising a pin head and a pin shaft, the pin head having a larger outer diameter than the pin shaft, wherein the pin head is received within the second collar with a close tolerance therebetween, and the pin shaft extends inwardly from the pin head through an opening in the locking mechanism, further comprising a metal barrier between the locking mechanism and the metal bracket, the metal barrier having a hole through which the pin shaft extends, wherein the hole has a smaller diameter than the outer diameter of the pin head, whereby a surface of the metal barrier surrounding the hole acts as a stop for the pin head thereby preventing any possible external abuse of the pin head from being transferred to the locking mechanism.

2. The container cover/door of claim 1, wherein studs extend inwardly from the metal bracket through aligned openings in the metal barrier and the locking mechanism housing, and nuts are threaded onto inner ends of the studs to secure the metal barrier and the locking mechanism to the metal bracket.

3. The cover/door of claim 1 further comprising means for preventing removal of the security pin from the cover/door.

4. The container cover/door of claim 3, wherein said means comprises a pin extending through a hole in an inner end of the pin shaft inwardly of the locking mechanism.

5. The container cover/door of claim 4, further comprising a washer interposed between the pin and the locking mechanism to take up any excess clearance space therebetween.

6. The container cover/door of claim 1, wherein the pin head has an outer face that contains a curvilinear groove pattern that is engageable by a designated pattern driver for rotating the security pin a part turn.

7. The container cover/door of claim 6, wherein the pin shaft has a non-cylindrical portion that matches a non-cylindrical opening in a metal body of the locking mechanism in which the non-cylindrical portion of the pin shaft is received, whereby when the security pin is rotated a part turn, the metal body is similarly rotated, causing the spring loaded latch to retract.

8. The container cover/door of claim 7, wherein the non-cylindrical portion of the pin shaft and the opening in the metal body of the locking mechanism have matching hex patterns.

9. The container cover/door of claim 1, wherein the metal bracket is welded to the inner side of the cover/door.

10. The container cover/door of claim 9, wherein the first collar is an extruded integral part of the cover/door and the second collar is an extruded integral part of the metal bracket.

11. The container cover/door of claim 1, wherein an outer end of the second collar and the security pin are flush or recessed with respect to the outer surface of the cover/door.

12. A container cover/door with locking system, the cover/door being made of metal and having an extruded first collar extending inwardly from an outer surface of the cover/door, the first collar defining a first through opening in the cover/door, a metal bracket welded to an inner surface of the cover/door, the metal bracket having a second extruded metal collar extending outwardly within the first collar, the second collar defining a second through opening in the metal bracket, and the locking system comprising a locking mechanism including a housing containing a spring loaded latch, the housing being mounted to an inner surface of the metal bracket, a security pin comprising a pin head and a pin shaft, the pin head having a larger outer diameter than the pin shaft, the pin head being flush mounted within the second collar with a close tolerance therebetween, and the pin shaft extending inwardly from the pin head through an opening in the locking mechanism, and a metal barrier between the locking mechanism and the metal bracket, the metal barrier having a hole through which the pin shaft extends, the hole having a smaller diameter than the outer diameter of the pin head, whereby a surface of the metal barrier surrounding the hole acts as a stop for the pin head.

13. The container cover/door of claim 12, wherein the pin head has an outer face that is flush with an outer end of the second metal collar, and the outer face of the pin head contains a curvilinear groove pattern that is engageable by a designated pattern driver for rotating the security pin a part turn.

14. The container cover/door of claim 13, wherein the pin shaft has a non-cylindrical portion that matches a non-cylindrical opening in a metal body of the locking mechanism in which the non-cylindrical portion of the pin shaft is received, whereby when the security pin is rotated a part turn, the metal body is similarly rotated, causing the spring-loaded latch to retract.

15. The container cover/door of claim 12, wherein studs extend inwardly from the metal bracket through aligned openings in the metal barrier and the locking mechanism housing, and nuts are threaded onto inner ends of the studs to secure the metal barrier and the locking mechanism to the metal bracket.

16. A container cover/door with high security locking system, the cover/door being made of metal and having a first through opening, a metal bracket fixedly attached to an inner surface of the cover/door, the metal bracket having a second through opening and the locking system comprising a locking mechanism including a housing containing a spring loaded latch, the housing being mounted to an inner surface of the metal bracket, and a security pin comprising a pin head and a pin shaft, the pin head having a larger outer diameter than the pin shaft, wherein the pin head is received within the second opening with a close tolerance therebetween, and the pin shaft extends inwardly from the pin head through an opening in the locking mechanism, further comprising a metal barrier between the locking mechanism and the metal bracket, the metal barrier having a hole through which the pin shaft extends, wherein the hole has a smaller diameter than the outer diameter of the pin head, whereby a surface of the metal barrier surrounding the hole acts as a stop for the pin head thereby preventing any possible external abuse of the pin head from being transferred to the locking mechanism.

17. The container cover/door of claim 16, wherein the pin head has an outer face that contains a curvilinear groove pattern that is engageable by a designated pattern driver for rotating the security pin a part turn, and the pin shaft has a non-cylindrical portion that matches a non-cylindrical opening in a metal body of the locking mechanism in which the non-cylindrical outer portion of the pin shaft is received, whereby when the security pin is rotated a part turn, the metal body is similarly rotated.

18. The container cover/door of claim 17, wherein the non-cylindrical portion of the pin shaft and the opening in the metal body of the locking mechanism have matching hex patterns.

* * * * *